United States Patent [19]

Macie

[11] Patent Number: 4,766,961

[45] Date of Patent: Aug. 30, 1988

[54] DECORATIVE QUICK RESPONSE SPRINKLER

[75] Inventor: Walter R. Macie, Yorktown Heights, N.Y.

[73] Assignee: The Reliable Automatic Sprinkler Co., Inc., Mount Vernon, N.Y.

[21] Appl. No.: 20,520

[22] Filed: Mar. 2, 1987

[51] Int. Cl.[4] ..... A62C 37/10

[52] U.S. Cl. ..... 169/38; 169/37

[58] Field of Search ..... 169/38, 90, 42, 37, 169/39, 40, 41

[56] References Cited

U.S. PATENT DOCUMENTS

| | | | |
|---|---|---|---|
| 3,195,647 | 7/1987 | Campbell et al. | 169/37 X |
| 4,015,665 | 4/1977 | Simons et al. | 169/42 X |
| 4,491,182 | 1/1985 | Pieczykolan | 169/38 |
| 4,508,175 | 4/1985 | Pieczykolan | 169/38 |
| 4,618,001 | 10/1986 | Hoening | 169/38 X |
| 4,618,002 | 10/1986 | Mears | 169/37 |
| 4,630,682 | 12/1986 | Pieczykolan | 169/38 |
| 4,664,198 | 5/1987 | Johnson | 169/38 |

*Primary Examiner*—Galen Barefoot
*Assistant Examiner*—James M. Kannofsky
*Attorney, Agent, or Firm*—Brumbaugh, Graves, Donohue & Raymond

[57] ABSTRACT

In the representative embodiment described in the specification, a decorative quick-response sprinkler has a hollow body normally sealed at its outer end by a valve which is retained in position by a valve-retaining assembly. The valve-retaining assembly has locking balls which are held in engagement with a groove in the sprinkler body by a bevelled locking disc with a push rod engaging a eutectic material in a tubular temperature-sensing element.

6 Claims, 2 Drawing Sheets

DECORATIVE QUICK RESPONSE SPRINKLER

BACKGROUND OF THE INVENTION

This invention relates to fire extinguishing sprinklers and, more particularly, to a new and improved sprinkler, having a decorative appearance and adapted to respond quickly to elevated temperature conditions indicative of a fire.

Sprinkler systems are widely used for automatic fire protection in residential, commercial and public buildings. Heretofore, many sprinklers have been made with a frame structure having a temperature responsive element located within the frame structure. In order to expose the temperature responsive element to ambient conditions, such sprinklers must be mounted so that the entire frame structure, with a deflector affixed at its outer end, projects downwardly from the ceiling, providing an unattractive appearance. Some conventional sprinklers have a slidable valve and deflector arrangement which is held in retracted condition by a complex captive locking mechanism which moves with valve from the closed to the open position.

SUMMARY OF THE INVENTION

Accordingly, it is an object of the present invention to provide a new and improved sprinkler which can be mounted close to a ceiling so as to be unobtrusive but at the same time, is capable of responding rapidly to elevated ambient temperature conditions resulting from a fire.

Another object of the invention is to provide a sprinkler of the foregoing type having a simple and compact structure which permits extension upon activation of the temperature responsive element.

These and other objects of the invention are attained in accordance with the invention by providing a sprinkler with a valve member which is normally retained in closed position by a valve-retaining assembly which is separable from the sprinkler upon activation of a temperature responsive element. More particularly, the valve-retaining assembly includes a plurality of locking balls retained in corresponding openings in a hollow support member disposed with the sprinkler housing so as to be received in an internal groove in the housing and thereby prevent motion of the valve member away from the closed position. Within the hollow support member a ball retainer is held in a ball-locking position by a temperature responsive element which is disposed at the outer extremity of the sprinkler so that, upon activiation of the temperature-responsive element, the valve-retaining assembly is separated from the sprinkler, permitting the valve to open.

Further objects and advantages of the invention will be apparent from a reading of the following description in conjunction with the accompanying drawings, in which:

DETAILED DESCRIPTION OF THE PREFERRED EMBODIMENT

Figure 1:
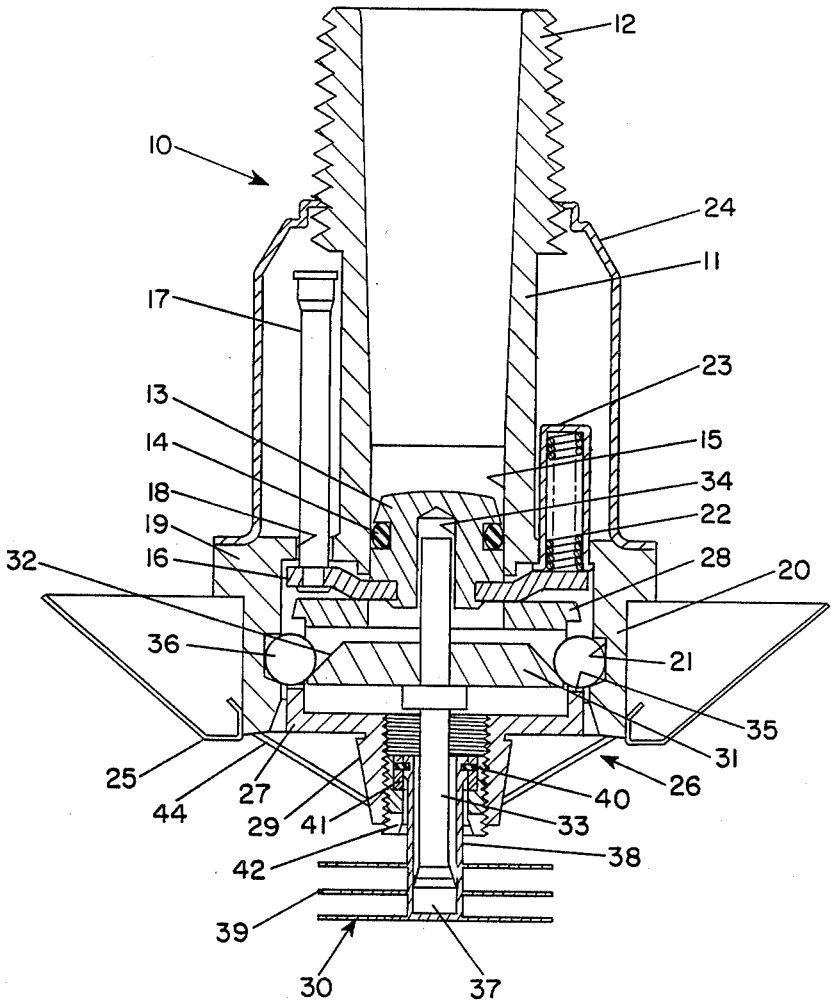
FIG. 1 is a longitudinal sectional view illustrating a representative quick response decorative sprinkler according to the present invention.

In the typical embodiment of the invention shown in FIG. 1, a sprinkler 10 includes a hollow body 11 threaded at one end 12 for attachment to a water supply pipe and normally closed at the other end by a valve plug 13 provided with an O-ring 14 which fits in sealing engagement with the bore 15 of the sprinkler body 11. At its outer end, the valve plug 13 carries a deflector 16 which serves to distribute the stream of water emerging from the bore 15 after the valve is opened.

Figure 2:
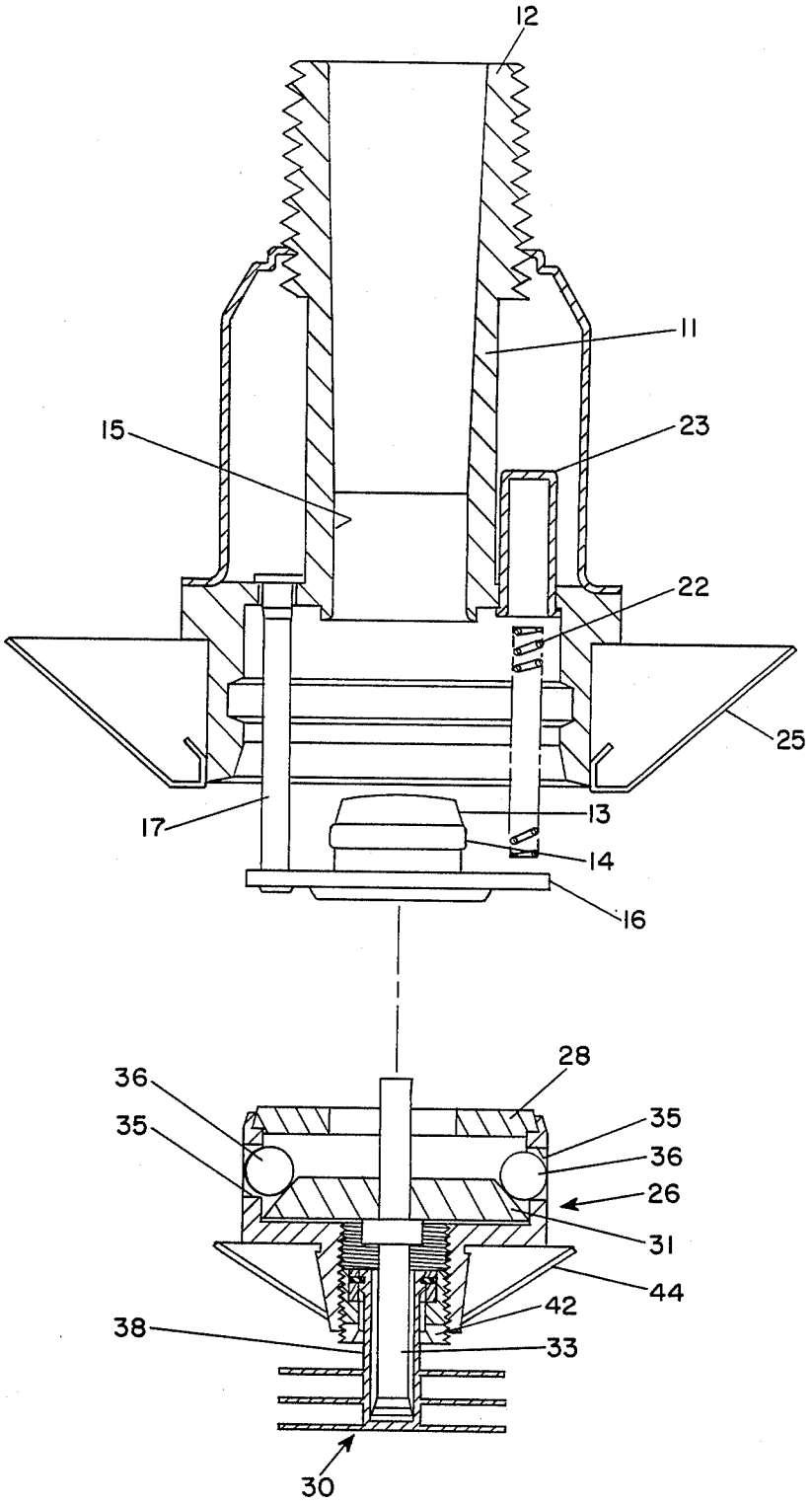
FIG. 2 is a view similar to that of FIG. 1, showing the sprinkler components following activation of the temperature responsive element.

The deflector 16 and the attached valve plug 13 are supported for motion between the closed position of the valve, shown in FIG. 1, and the open position of the valve, shown in FIG. 2, by a plurality of guide pins 17, only one of which is illustrated in the drawings. The guide pins are distributed uniformly around the axis of the sprinkler and each guide pin passes through a corresponding opening 18 in a flange 19 extending outwardly from the open end of the sprinkler body 11 and terminating in an annular projection 20 formed with an internal annular groove 21. The guide pins are formed with enlarged heads to prevent them from passing through the openings 18.

A compression spring 22, enclosed in a spring housing 23 mounted in the flange 19, urges the deflector 16 along with the valve plug 13 in downward direction as shown in the drawings, tending to open the valve. A cover 24 engaging the threaded end of the sprinkler body encloses the guide pins and spring housing and an escutcheon plate 25 is frictionally supported on the outer surface of the sprinkler body projection 20.

In order to releasably retain the valve plug 13 in the closed position, a separable valve retaining assembly 26 is provided. The retaining assembly includes a retaining housing 27 having a cover 28 at one end abutting the valve plug 13 and deflector 16 and a support bushing 29 for a temperature sensitive element 30 at the opposite end. Within the retainer housing 27 a locking disc 31 having a bevelled outer edge 32 is slidably supported for axial motion by a central push rod 33 which extends through the locking disc 31 into an axial bore 34 in the valve plug 13 at one end and into the temperature-sensitive element 30 at the opposite end. The retainer housing 27 has a number of circular apertures 35 in its peripheral surface and within each aperture is a locking ball 36 which projects into the internal groove 21 in the valve body projection 20 so as to hold the valve retaining assembly locked in its valve-retaining position.

The locking balls 36 are held in engagement with the internal groove 21 by the bevelled rim 32 of the locking disc 31 as long as the push rod 33 is in the uppermost position as viewed in the drawings. The push rod is normally retained in its uppermost position by a cylindrical plug 37 of a eutectic material such as solder by which the end of the push rod is held in spaced relation from the bottom of a central opening in a tubular heat sensor 38. The heat sensor 38, which is the only exposed part of the sprinkler, has three spaced disc-shaped fins 39 through which changes in the ambient temperature are communicated rapidly to the solder plug 37 to assure a quick response of the sprinkler when the ambient temperature reaches a predetermined level, such as 165° F., at which the solder plug is designed to melt.

At its inner end, the tubular heat sensor carries a retaining ring 40 and a heat insulating washer 41 transmits an upward force on the ring 40 from a threaded ring 42 which is received in internal threads in the bushing 29. Thus, as long as the solder plug 37 remains solid, the push rod 33 will be urged upwardly by the threaded ring acting through the heat insulating washer, the retaining ring and the tubular heat sensor. A cover plate 44, affixed to the bushing 29, blends with the escutcheon plate 25, providing a decorative appearance to the sprinkler when it is mounted in the ceiling.

In operation, when the ambient temperature is increased by a fire or the like to a predetermined level, such as 165° F., the solder plug 37 melts, permitting the push rod 33 and locking disc 31 to move downwardly. The compression spring 22, together with the pressure of the water in the sprinkler which is applied to the valve plug 13, urges the valve-retaining assembly 26 downwardly as viewed in the drawings, forcing the balls 36 inwardly in the apertures 35. Since the locking disc 31 is now free to move downwardly, the locking balls 36 can move into the valve retaining assembly, releasing that assembly from the sprinkler body and permitting it to be separated as illustrated in FIG. 2. At the same time, the valve plug 13 and the deflector 16 move downwardly until heads of the guide pins 17 engage the flange 19. In this condition, the water emerging under pressure from the sprinkler is distributed uniformly about the adjacent area by the deflector 16.

Although the invention has been described herein with reference to a specific embodiment, many modifications and variations therein will readily occur to those skilled in the art. Accordingly, all such variations and modifications are included within the intended scope of the invention as defined by the following claims.

I claim:

1. A quick-response sprinkler comprising a hollow body member having an inlet end and an outlet end; valve means including a valve plug and a deflector supported from the hollow body member for limited motion between a closed position wherein the valve plug forms a fluid-tight seal within the outlet end of the hollow body member and an open position in which the valve plug is spaced from the outlet end so as to prevent obstruction of liquid emerging therefrom; the hollow body member having an internal groove spaced outwardly from the outlet end and outwardly from the deflector in the closed position of the valve means; locking means for holding the valve means in the closed position and for releasing the valve means in response to elevated temperature; the locking means having a surface normally retained in fixed abutting relation to a surface of the valve means to normally retain the valve means in the closed position and being completely separable from the hollow body member and the valve means and comprising a housing, a plurality of locking balls supported in the housing for motion toward and away from the internal groove in the body member; locking disc means movable in the axial direction within the housing and having an inclined surface engaging the locking balls; and temperature responsive means at the extremity of the sprinkler adjacent the outlet end, the temperature-responsive means normally supporting the locking disc means in a position holding the locking balls in the internal groove so as to retain the locking means housing in position with said surface in fixed abutting relation to the valve means surface but separable therefrom to hold the valve means in closed position to hold the valve plug in fixed position within the outlet end and responsive to an elevated temperature to release the locking disc means and the locking balls and permit the locking means to be separated from the sprinkler body and the valve means, thereby releasing the valve means from its closed position.

2. A sprinkler according to claim 1 including spring means engaging the deflector to urge the deflector and the valve means toward the open position.

3. A sprinkler according to claim 1 wherein the temperature-responsive means includes a tubular member retained by the locking means housing and containing a plug of eutectic material at its external end and the locking disc means includes a push rod engaging the plug of eutectic material.

4. A sprinkler according to claim 3 wherein the tubular member has a plurality of disc-shaped fins at its external end and including insulating washer means interposed between the tubular member and the locking means housing.

5. A sprinkler according to claim 3 wherein the locking means housing is internally threaded and including thread means engageable with the internally threaded housing for retaining the tubular member in the locking means housing.

6. A sprinkler according to claim 3 including an axial recess in the valve means and wherein the locking disc means push rod extends into the axial recess in the valve means.

* * * * *